United States Patent [19]

Povajnuk

[11] Patent Number: 4,590,774

[45] Date of Patent: May 27, 1986

[54] ICEMAKER

[76] Inventor: Walter Povajnuk, 575 Tena Place, Victoria, British Columbia, Canada, V9C 1M6

[21] Appl. No.: 568,126

[22] Filed: Jan. 4, 1984

[30] Foreign Application Priority Data

Sep. 6, 1983 [CA] Canada ..... 436140

[51] Int. Cl.[4] ..... F25C 1/12

[52] U.S. Cl. ..... 62/347; 62/348; 62/352

[58] Field of Search ..... 62/347, 348, 352, 73, 62/74

[56] References Cited

U.S. PATENT DOCUMENTS 3,430,452 3/1969 Dedricks et al. ..... 62/347 X
4,255,941 3/1981 Bouloy ..... 62/347
4,344,298 8/1982 Biemiller ..... 62/347
4,412,429 11/1983 Kohl ..... 62/347

*Primary Examiner*—William E. Tapolcai
*Attorney, Agent, or Firm*—Shlesinger, Arkwright, Garvey & Fado

[57] ABSTRACT

An icemaker having a thermally conductive tube with a coolant inlet and outlet and at least one substantially flat ice-forming elongated surface. An elongated thermally non-conducting strip of material on each long side edge of the tube with an outer surface continuous with the ice-forming surface and a plurality of spacers, each extending across the elongated surface at spaced apart intervals with a means for releasably holding the spacers against the elongated surface, also including a means for passing a curtain of water over said elongated surface.

10 Claims, 6 Drawing Figures

ICEMAKER

BACKGROUND OF THE INVENTION

The present invention relates to an icemaker for automatically making ice cubes.

Conventional icemaking systems exhibit a wide variety of structures. For example, U.S. Pat. No. 2,997,861 issued to Kocher discloses a plurality of vertically-separated, substantially horizontal coil tubes interconnectd at their ends and then longitudinal and transverse external fins which divide the external tubes into local segregated freezing zones within which ice briquets are formed.

U.S. Pat. No. 3,913,349 issued to Johnson discloses an icemaker having serpentine evaporator coils and a grid for molding ice cubes. The apparatus includes a header mounted on an upper frame section which contains water. Water flows through openings over the grid and is frozen by the latter to form the ice cubes.

None of the foregoing structures nor any known systems include a means for providing a simple adjustment to the size of ice cubes nor do any known automatic icemakers provide ice cubes which are substantially rectangular in shape.

STATEMENT OF THE INVENTION

According to the invention there is provided an icemaker consisting of a thermally conductive tube having a coolant inlet and outlet and at least one substantially flat ice-forming elongated surface. On each long side edge of the tube there is mounted an elongated sheet of material having an outer surface continuous with the ice-forming surface. A plurality of thermally non-conductive spacers extend across the elongated surface of the tube at spaced-apart intervals thereon. Means are provided for releasably holding the spacers against the elongated surface. Means are also provided for passing a curtain of water over the elongated surface at a preselected rate of flow.

Advantageously, the tube has a pair of opposed elongated flat ice-forming surfaces.

Preferably, the thermally non-conducting sheet of material extends along each side edge of the tube and has opposed spacers which are continuous with associated adjacent ice-forming surfaces of the tube.

The icemaker may further include sump means for catching water after it has passed over the elongated surfaces, float valve means for adding make up water to the sump in the response to the water level therein, pump means for pumping the water out of the sump and a header for receiving and distributing the pumped water over the elongated surface.

The icemaker may be comprised of an assembly of thermally conductive spaced apart tubes with thermally nonconductive elongated strips of material along each side edge of each tube, the long side edges of opposed strips of material having a gap therebetween. The spacers may extend across the elongated ice-forming surfaces of the tubes at spaced apart intervals thereon.

The spacers may be aligned in pairs one on one side of the assembly with another on an opposite side thereof at spaced apart intervals over the assembly with each spacer extending across all of the ice-forming surfaces on its associated side of the assembly. Pairs of spacers may be interconnected by removable screws passing through the gap between adjacent non-conducting elongated strips of material.

By providing flat ice-forming elongated surfaces, substantially solid rectangular ice cubes are formed. By simply loosening the fastening screws interconnecting pairs of spacers, each pair can be slid along the assembly and adjusted relative to one another to change the size of the ice cube formed as desired. Most other known structures require substantial mechanical change in order to effect a change in ice cube size.

The gaps between adjacent strips of material which permit the passage therethrough of fastening screws also serve the function of compensating for any difference in water flow between opposed surfaces of the assembly. Any side which experiences a higher flow than the other has some of its water distributed to the other side through the gaps. Thus, the gaps serve as a flow equalizer between the two sides.

BRIEF DESCRIPTION OF THE DRAWINGS

In drawings of a preferred embodiment of the device.

DETAILED DESCRIPTION WITH REFERENCE TO THE DRAWINGS

Figure 1:
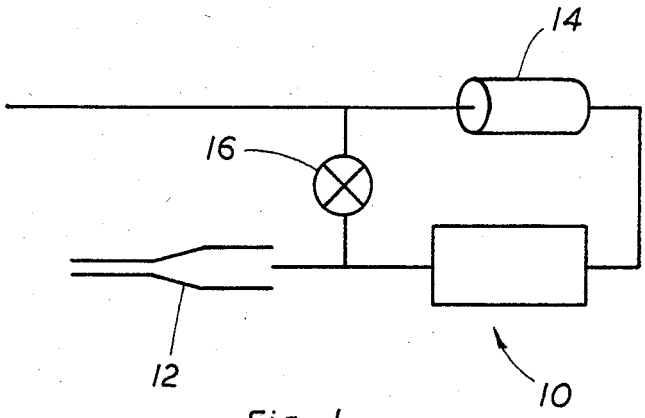
FIG. 1 is a schematic diagram showing how the icemaker is incorporated into a refrigeration system.

A schematic illustration of how an icemaker 10 is incorporated into a refrigeration system as illustrated in FIG. 1. The compressed coolant passes through an expansion nozzle 12 after which its temperature is lowered. It is then directed through the icemaker 10 wherein it absorbs heat from water and turns the latter into ice. The warmed coolant is then directed to a compressor 14 after which it is cooled and re-directed through the refrigeration cycle back to the nozzle 12. Once the icemaker 10 has completed its ice-forming function a solenoid valve directs the hot gas from the compressor 14 through the icemaker and releases ice cubes in the latter. The whole cycle is once again repeated.

Figure 2:
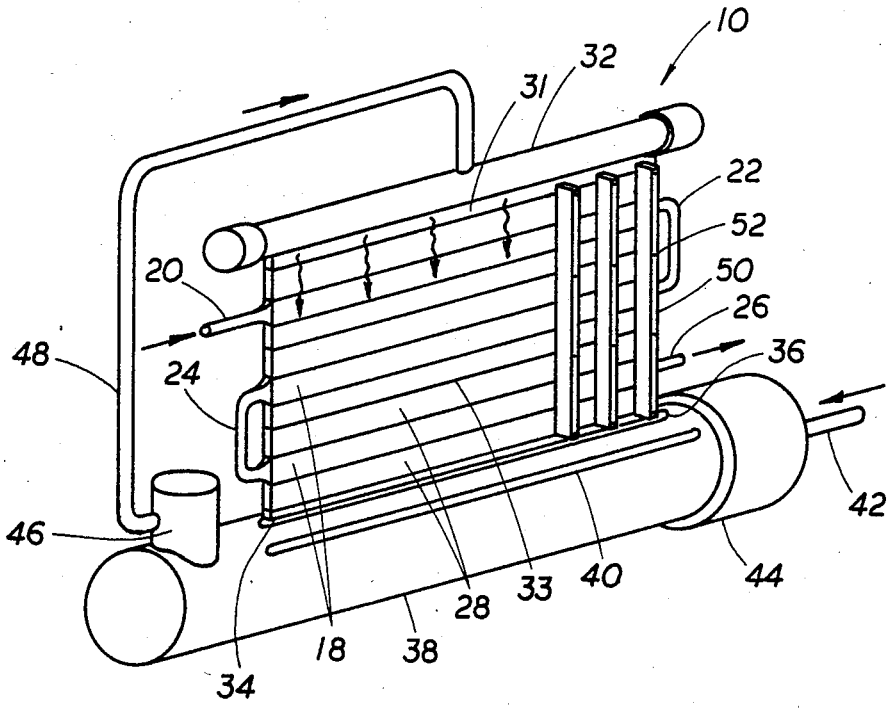
FIG. 2 is a perspective view of the icemaker assembly.
Figure 4:
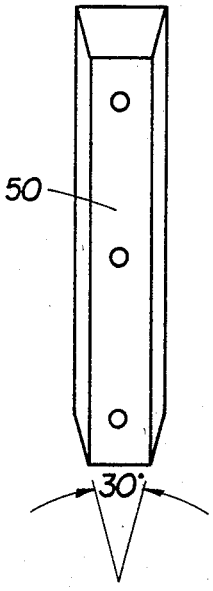
FIG. 4 is a perspective view of a spacer.

The icemaker assembly 10 as illustrated in FIG. 2 consists of a plurality of elongated copper tubes 18 having opposed substantially flat ice-forming surfaces. On either elongated side edge of each tube 18 are elongated plastic strips 28 whose outer surfaces are continuous with the ice-forming surfaces of the tubes 18. In order to ensure such continuity, silicone rubber sealant may be used in the junction between the tube and plastic strips to ensure that there are no recessed portions of the copper tube upon which ice may form. The stacked array of tubes 18 and plastic strips 28 are held in place by end plates (not shown) which fit around the end edges of the tubes and elongated plastic strips. The plastic strips are constructed such that at the junction between adjacent strips, there is an elongated gap 33 running along the whole length of the strips except for shoulders at either end on one of the strips. A plurality of spacers 50 are mounted against each side of the assembly by means of screws 52 which pass through one of the spacers, through the gap 33 and are threadedly received by a threaded receptacle 51 in an aligned spacer 54 on the opposite side of the assembly. Only a few spacers 50 are shown in FIG. 2 but there are normally a sufficient number to extend across the length of the tubes. In FIG. 4, the shape of the spacers is seen to include sidewalls which converge with an included angle of approximately 30° in order to facilitate release of the ice cubes. By simply loosening screws 52 slightly, a pair of spacers 50 and 54 can be slid along the assembly to any desired position. Since ice forms between two adjacent spacers 50, such movement provides for an adjustment in the size of the ice cubes formed on the ice-forming surfaces of tubes 18 between the spacers.

Figure 3:
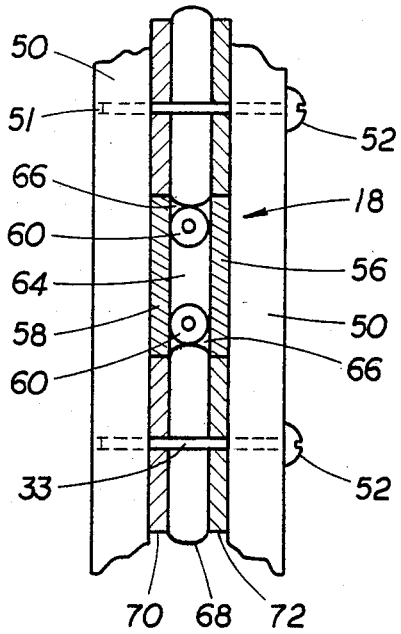
FIG. 3 is a partial sectional view taken through the assembly substantially parallel to the spacers.
Figure 5:
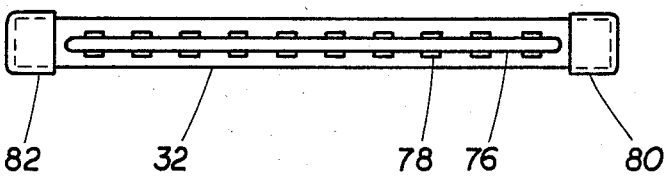
FIG. 5 is a bottom view of the header as removed from the assembly.

The details of construction of the elongated copper tubes 18 and the strips of plastic 28 as illustrated by FIG. 3 include a pair of elongated copper tubes or rods 60. The rods are affixed to the sheets by means of solder 66 running along the outer edges. The copper sheets thus joined form a passage for coolant 64 through the centre of the tube 18. The plastic strips 50 along each edge of the tube 18 consist of a central sheet 68 having a rounded edge for fitting inside a concave solder surface along the central edge of the tube. On each side of the central sheet 68 are a pair of elongated sheets 70 and 72 which are glued to the central sheet.

The header pipe 32 has an elongated slot 76 running almost the full length thereof and a plurality of widened areas 78 on either side of the slot 76. The ends of the pipe 32 are closed by caps 80 and 82. The slot 76 fits over a strip 31 at the top of the assembly and water escapes through the widened areas 78 providing a curtain of water coming down each side of the assembly.

Figure 6:
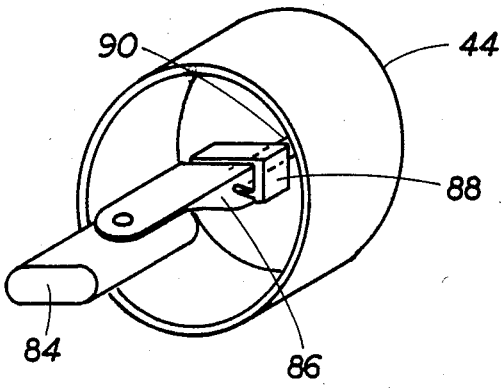
FIG. 6 is a perspective of an end of the sump showing a float valve assembly.

The top tube 18 in the assembly has a coupling pipe 20 connected at one end for receiving coolant and the other end is coupled to the adjacent tube by means of a U-shaped pipe 22 at the opposite end. A similar coupling 24 couples the second and third tubes and the opposite end of the third tube has a pipe coupling 26 for directing coolant out of the assembly. A sump pipe 38 has an elongated slot 36 for receiving a bottom strip 34 of the assembly and for catching water running down the sides of the assembly. Any water which is not caught by the slot 36 is trapped by slots 40 on either side of slot 36. Sump 38 has a pump 46 at one end thereof for pumping water from the sump 38 into pipe 48 which is coupled to the header 32. At the opposite end of the sump 38 is float valve assembly 44 as illustrated in FIG. 6. A water pipe 42 leading into the assembly 44 is controlled by a valve 88 consisting of a float 84 and valve closure member 86 rotatable about a pin so as to open and close the valve 88. With the sump full of water, float 84 is elevated and causes valve closure member 86 to close valve 88. When the water level in the sump is low, float 84 falls thereby opening the valve 88 and allowing water to enter into the sump.

In operation, the spacers 50 on each side of the assembly 10 are adjusted to provide ice cubes of the desired dimensions. As coolant fluid enters the top tube 18 through the coupling pipe 20 and passes through the remaining tubes, the outer ice-forming surfaces of those tubes become cooled. As the curtains of water provided on both sides of the assembly pass over the ice-forming surfaces of each tube, ice begins to form between the spacers 50. Any water which has not become frozen enters the sump 38 through the slot 36 or side slots 40. Make up water is provided through water inlet pipe 42 and through the float valve assembly 44 into the sump 38. Water in the sump is recirculated by the pump 46 through pipe 48 into header pipe 32. The gaps 33 between adjacent strips also function to allow any excess water on one side of the assembly to pass through the other side of the assembly and thereby evenly distributes the water on both sides thereof.

Once the ice has reached a pre-determined thickness, a thermocouple (not shown) which is contacted by the ice once it has reached this thickness sends a control signal to the solenoid valve 16 causing it to open and send hot gas through the pipes 18 rather than coolant. The flow of coolant is choked off by the hot gas and the ice thus formed is thereby released from the ice-forming surfaces of the tubes 18. The cycle is once again repeated.

Other variations, modifications and departures lying within the spirit of the invention in the scope as defined by the appended claims will be obvious to those skilled in the art.

I claim:

1. An icemaker comprising;

(a) a thermally conductive tube having a coolant inlet and outlet and at least one substantially flat ice-forming elongated surface;

(b) an elongated thermally non-conducting strip of material on each long side edge of said tube having an outer surface continuous with said ice-forming surface;

(c) a plurality of spacers, each extending across said elongated surface at spaced apart intervals thereon;

(d) means for releasably holding said spacers against said elongated surface;

(e) means for passing a curtain of water over said elongated surface.

2. An icemaker as defined by claim 1, wherein said tube has a pair of opposed elongated flat ice-forming surfaces.

3. An icemaker as defined by claim 2, wherein said thermally non-conductive strip of material extends along each long side edge of said tube and has opposed faces which are each continuous with associated adjacent ice-forming surfaces of said tube.

4. An icemaker as defined by claim 2, further including sump means below said tube and strips for catching said water after it has passed over said elongated surfaces, float valve means in said sump for adding make up water to said sump in response to the water level in said sump, pump means in said sump for pumping said water out of said sump and, a header above said tube and strips for receiving and distributing the pumped water over said elongated surfaces.

5. An icemaker comprising:

(a) an assembly of thermally conductive spaced-apart tubes having a pair of substantially opposed ice-forming outer elongated surfaces, said tubes interconnected in fluid communication to permit coolant fluid to pass through each tube in succession, and a thermally non-conductive elongated strip of material along each side edge of each tube, the outer opposed surfaces of each of said strips being continuous with corresponding ice-forming surfaces of associated ones of said tubes, such that the long side edges of opposed strips have a gap therebetween;

(b) a plurality of spacers each extending across elongated ice-forming surfaces of said tubes on one side of said assembly at spaced-apart intervals thereon;

(c) means for releasably holding said spacers against said ice-forming surfaces;

(d) a header located at the upper end of said assembly of tubes and strips for distributing a curtain of water in a pre-selected rate of flow down each side thereof;

(e) a sump for catching excess water flowing down from a bottom of said assembly of tubes and strips;

(f) a float valve for controlling a flow of make up water into said sump;

(g) a pump on said sump for pumping water therefrom into said header.

6. An icemaker as defined by claim 5, wherein said spacers are aligned one on one side of said assembly with another on an opposite side thereof and each spacer extends across all of the ice-forming surfaces on its associated side of said assembly.

7. An icemaker as defined by claim 5, wherein said header has an elongated slot for receiving an upper end of said assembly of tubes and strips and channel means for permitting curtains of water to flow out of said slot and down each side of said assembly.

8. An icemaker as defined by claim 7, wherein said channel means includes a plurality of spaced apart widened sections in said slot.

9. An icemaker as defined by claim 6, wherein said pairs of spacers are connected by removable screws passing through the gap between adjacent non-conducting strips.

10. An icemaker as defined by claim 5, wherein said sump is a tubular assembly having an elongated slot for receiving a lower end of said assembly of tubes and strips and for admitting into the interior of said sump water flowing down said assembly of tubes and strips and spaced-apart auxilliary elongated slots to intercept water flowing down the outer surface of said sump.

* * * * *